US005402871A

United States Patent [19]

Mercurio

[11] Patent Number: 5,402,871

[45] Date of Patent: Apr. 4, 1995

[54] DROP COIN MECHANISM

[75] Inventor: Leonard Mercurio, Dix Hills, N.Y.

[73] Assignee: Set-O-Matic, Inc., Farmingdale, N.Y.

[21] Appl. No.: 139,932

[22] Filed: Oct. 20, 1993

[51] Int. Cl.[6] ..... G07F 1/02

[52] U.S. Cl. ..... 194/203; 194/343

[58] Field of Search ..... 194/202, 203, 342, 343, 194/344, 346, 347, 349, 351

[56] References Cited

U.S. PATENT DOCUMENTS

| | | | |
|---|---|---|---|
| 529,655 | 11/1894 | Lamplough | 194/203 |
| 896,012 | 8/1908 | Hanson | 194/343 |
| 1,010,741 | 12/1911 | Dreher | 194/343 |
| 1,594,066 | 7/1926 | Mills | 194/343 X |
| 1,619,654 | 3/1927 | Chandler | 194/203 |
| 1,987,292 | 1/1935 | Gorton | 194/343 |
| 4,509,630 | 4/1985 | Mongelli | 194/343 |

*Primary Examiner*—Michael S. Huppert
*Assistant Examiner*—Scott L. Lowe
*Attorney, Agent, or Firm*—Amster, Rothstein & Ebenstein

[57] ABSTRACT

A drop coin mechanism for use with a coin authentication and counting apparatus prevents tampering with such apparatus and includes a faceplate defining an aperture therethrough for passage of a coin, the faceplate aperture being substantially completely offset from an entrance into the coin authenticating and counting apparatus. A slidable chamber enables moving the coin from a coin-receiving position to a coin-discharging position, the coin in the coin-receiving position being generally aligned with the faceplate aperture and substantially completely offset from the entrance to the coin authenticating and counting apparatus, the coin in the coin-discharging position being substantially completely offset from the faceplate aperture and generally aligned with the entrance to the coin authenticating and counting apparatus. Accordingly, no tool for tampering with the coin authenticating and counting apparatus can be inserted into the entrance thereof through the faceplate aperture.

18 Claims, 4 Drawing Sheets

DROP COIN MECHANISM

BACKGROUND OF THE INVENTION

The present invention relates generally to the field of drop coin mechanisms used with coin-operated commercial appliances and equipment, and more particularly to an improved form thereof which is suitable for replacing existing drop coin mechanisms in coin-collecting boxes and prevents tampering with the coin authentication and counting apparatus.

A drop coin mechanism is typically used in conjunction with a coin authentication and counting apparatus. The counting apparatus may be no more than a photocell which records each interruption of its light beam as a valid coin, the validation of the coin having been previously performed by the coin authentication apparatus. In a slide coin mechanism wherein a coin is placed into an aperture in the slide element and the slide element is then passed into the entrance of the coin authenticating and counting apparatus, the opportunity for tampering with the counting apparatus is severely limited as there is no room for a tampering tool when the slide element enters the limited entrance of the slide element receives. On the other hand, in a drop coin mechanism there is typically a clear, open (although not necessarily linear) passage from the coin entry slot to the coin counting apparatus. This enables the potential tamperer to insert a flexible tampering tool into the coin entry slot, through the coin authentication apparatus, to the coin counting apparatus where the leading end of the tool is easily moved back and forth to simulate the passages thereby of coins. Accordingly, slide coin mechanisms have been preferred over drop coin mechanisms because of their lower susceptibility to tampering, even though they are subject to wear, jamming, and other problems during operation and are harder to adapt for the acceptance of a greater number of coins (as may be necessitated by the increased cost of continued operation of the appliances with the passage of time).

Accordingly it is an object of the present invention to provide a drop coin mechanism for use with a coin authentication and counting apparatus for preventing tampering with such apparatus.

Another object is to provide such a drop coin mechanism which is configured and dimensioned to replace existing drop coin mechanisms or otherwise fit in the limited space available for a drop coin mechanism provided by an appliance manufacturer.

A further object is to provide such a drop coin mechanism which includes return means for undersized coins.

SUMMARY OF THE INVENTION

It has now been found that the above and related objects of the present invention are obtained in a drop coin mechanism for use with a coin authentication and counting apparatus for preventing tampering with such apparatus. The mechanism comprises a faceplate defining an aperture therethrough for passage of a coin, the faceplate aperture being substantially completely offset from the entrance into the coin authenticating and counting apparatus. Means are provided for moving the coin from a coin-receiving position to a coin-discharging position. The coin in the coin-receiving position is generally aligned with the faceplate aperture and substantially completely offset from the entrance to the coin authenticating and counting apparatus, and the coin in the coin-discharging position is substantially completely offset from the faceplate aperture and generally aligned with the entrance to the coin authenticating and counting apparatus. Thus, a tool for tampering with the coin authenticating and counting apparatus cannot be inserted into the entrance thereof through the faceplate aperture.

Preferably the mechanism has a coin transfer means defining a coin-holding body, an entrance thereto and an exit therefrom, the transfer means being movable between a coin-receiving position and a coin-discharging position. The transfer means in the coin-receiving position has the transfer means entrance aligned with the faceplate aperture and the transfer means exit substantially completely offset from an entrance to a coin authenticating and counting apparatus, and the transfer means in the coin-discharging position has the transfer means entrance substantially completely offset from the faceplate aperture and the transfer means exit aligned with the entrance to the coin authenticating and counting apparatus. The faceplate aperture is substantially completely offset from the entrance into the coin authenticating and counting apparatus such that tools for tampering with the coin authenticating and counting apparatus cannot be inserted into the entrance thereof through the faceplate aperture.

In a preferred embodiment, the transfer means entrance and the transfer means exit are aligned along a longitudinal axis, and the transfer means is movable between the coin-receiving position and the coin-discharging position laterally along an axis generally transverse to the longitudinal axis. The moving means is operable from the front of the faceplate. The mechanism may additionally include means for biasing the transfer means to the coin-receiving position. The moving means also moves the transfer means from the coin-discharging position to the coin-receiving position.

In a preferred embodiment the mechanism additionally includes a size authenticating mechanism. Thus, the faceplate aperture is configured and dimensioned to preclude passage therethrough of a coin oversized relative to an acceptable coin. Restraining means are disposed in the coin-holding body for limiting longitudinal movement of an acceptable coin from the transfer means entrance through the coin-holding body while the transfer means is in the coin-receiving position, while permitting a coin undersized relative to an acceptable coin to advance from the transfer means entrance through the coin-holding body. The restraining means is disposed a fixed distance above the bottom of the coin-holding body, and the transfer means is movable relative to the restraining means between an operable position wherein the restraining means restrains an acceptable coin from movement into the coin-holding body and an inoperable position higher than the operable position, the size authenticating mechanism additionally including means biasing the transfer means to the operable position. Means are provided for moving a coin in the coin-holding body laterally relative to the transfer means as the transfer means moves from the coin-receiving position to the coin-discharging position. The faceplate additionally defines a coin-return aperture therethrough for return to the user of a coin which has been laterally moved relative to the transfer means by the moving means.

The present invention also encompasses a drop coin mechanism for use with a coin authentication and counting apparatus for preventing tampering with such apparatus. The mechanism comprises a faceplate defining an aperture therethrough for passage of a coin, and a coin transfer means defining a coin-holding body, an entrance thereto and an exit therefrom. The transfer means entrance and the transfer means are offset from one another, the transfer means having the transfer means entrance at least at times aligned with the faceplate aperture and the transfer means exit at least at times aligned with an entrance to a coin authenticating and counting apparatus. Means are provided for moving a coin from a coin-receiving position to a coin-discharging position, the coin in the coin-receiving position being substantially completely offset from the entrance to the coin authenticating and counting apparatus and in the coin-discharging position being substantially completely offset from the faceplate aperture. The faceplate aperture is substantially completely offset from the entrance into the coin authenticating and counting apparatus such that tools for tampering with the coin authenticating and counting apparatus cannot be inserted into the entrance thereof through the faceplate aperture.

In a preferred embodiment, the moving means moves the coin from the coin-receiving position to the coin-discharging position laterally, is operable from the front of the faceplate, and includes means for biasing the moving means to the coin-receiving position.

The present invention broadly encompasses any drop coin mechanism for use with a faceplate defining an aperture therethrough for passage of a coin and a coin counting apparatus wherein the mechanism prevents tampering with such counting apparatus via the faceplate aperture. The mechanism comprises a first path defined by a plane encompassing an aperture in a faceplate for passage therethrough of a coin, a second path defined by a plane laterally offset and generally parallel to the plane of the first path and encompassing a coin counting means, and means for moving the coin from the first path to the second path, whereby the coin counting means is inaccessible to a linear element inserted into and through the slot of the faceplate.

In a preferred embodiment, the first path is linear, the moving means moves only a coin of acceptable size from the first path to the second path, and means are provided for preventing an undersized coin from moving from the first path to the second path.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 2:
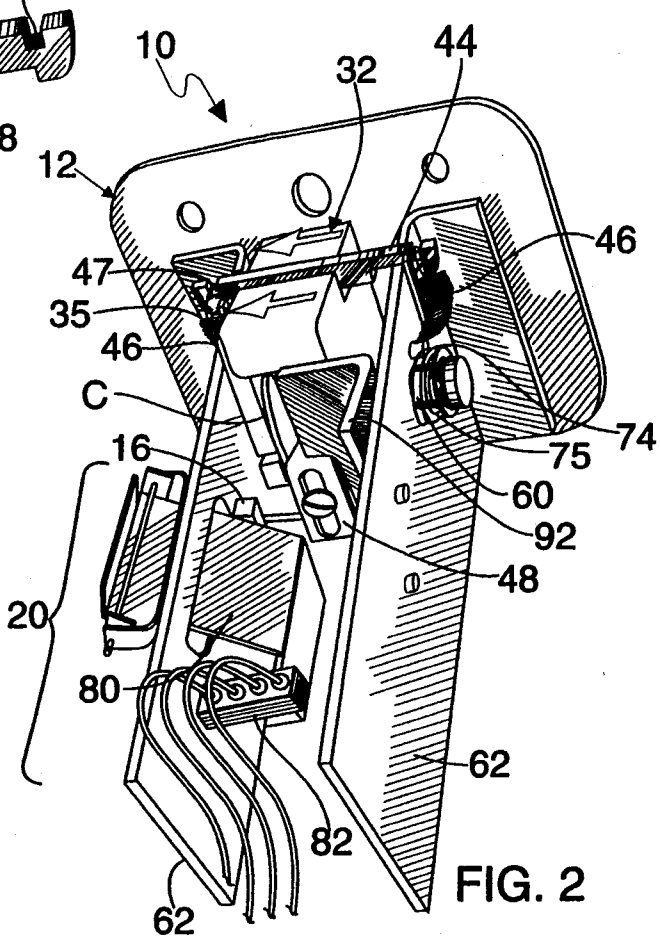
FIGS. 1 and 2 are rear perspective views of a drop coin mechanism according to the prevent invention in the initial orientation and an intermediate orientation, respectively.
Figure 1:
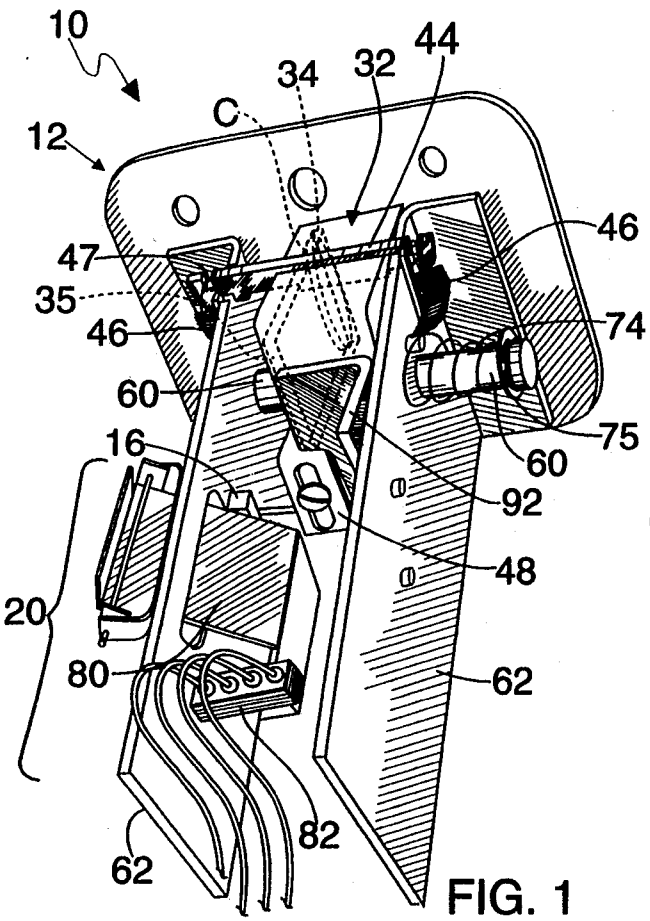
Figure 3:
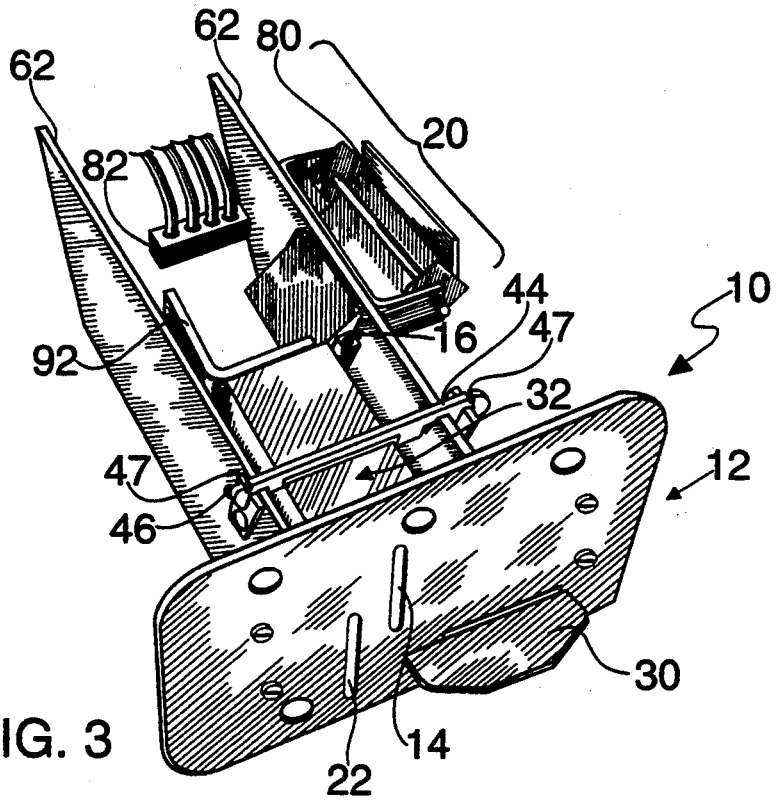
FIGS. 3 and 4 are front perspective views thereof in the initial orientation and an intermediate orientation, respectively.
Figure 4:
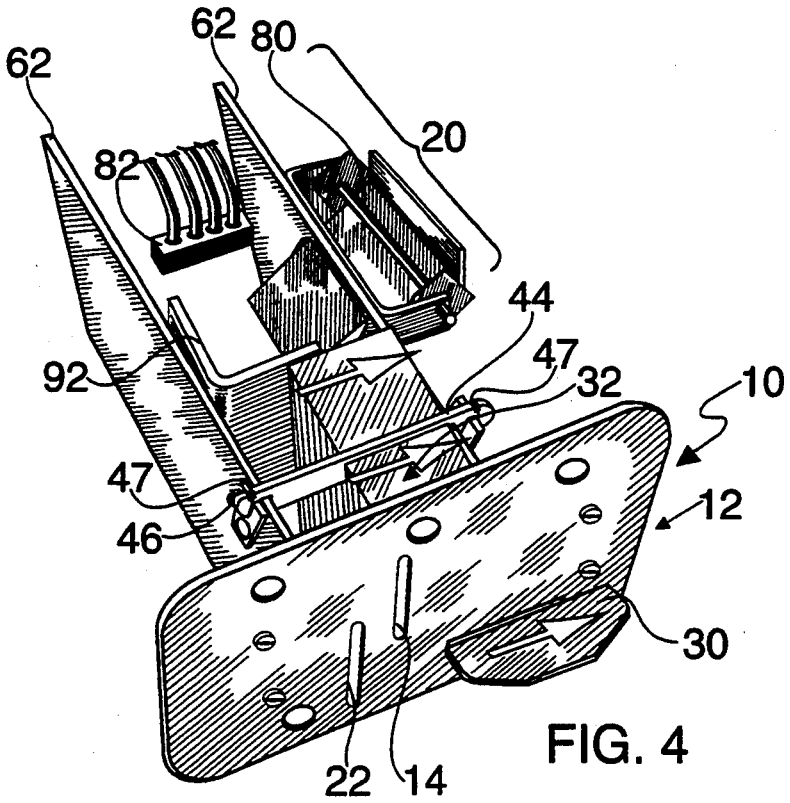
Figure 5:
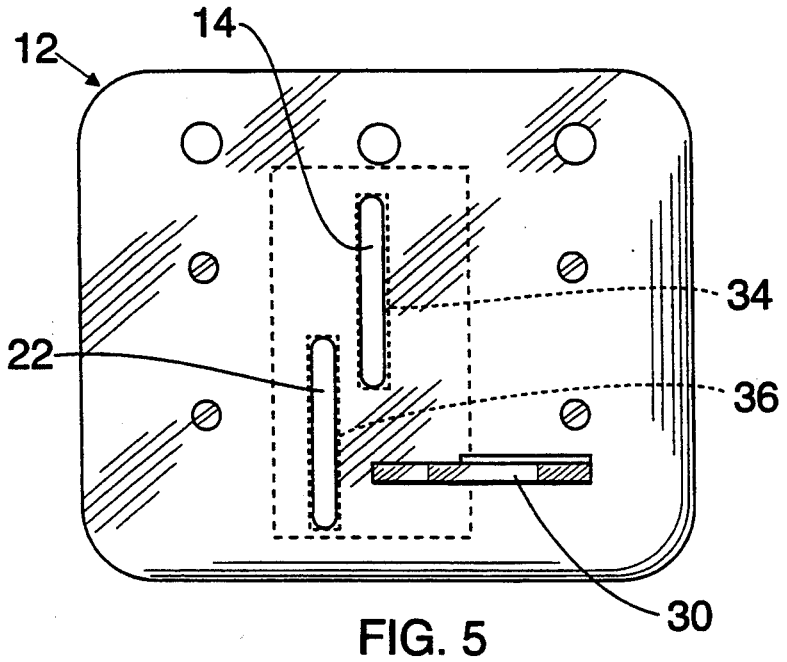
FIGS. 5 and 6 are front elevational views of the faceplate thereof in the initial orientation and an intermediate orientation, respectively.
Figure 6:
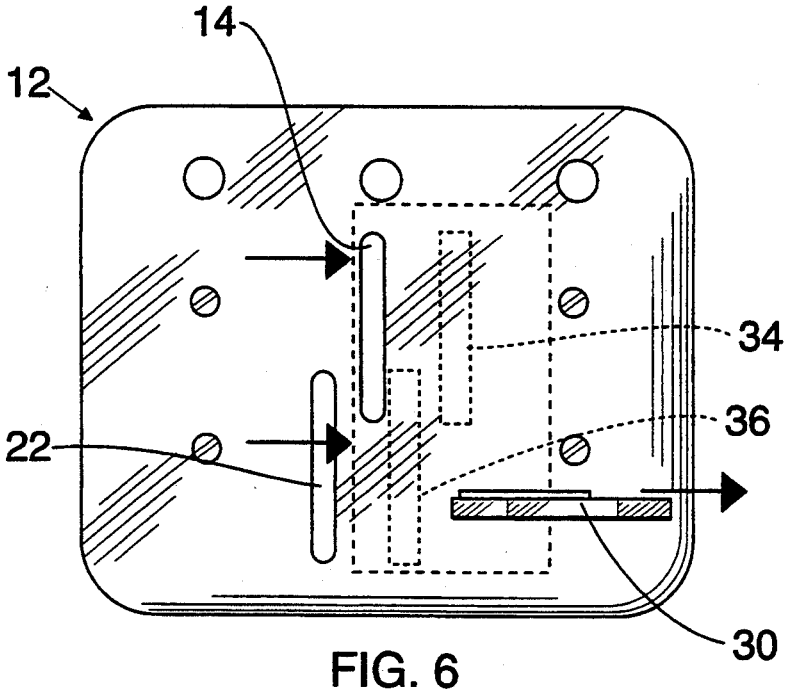

Referring now to the drawing, a drop coin mechanism according to the present invention is illustrated in its initial orientation relative to a coin authentication and counting apparatus in FIGS. 1, 3 and 5, and in an intermediate orientation in FIGS. 2, 4 and 6. The drop coin mechanism is generally designated by the reference numeral 10.

The drop coin mechanism 10 includes a faceplate generally designated 12 defining a coin entry aperture 14 therethrough for entry of the coin C by a customer. The faceplate aperture 14 is substantially completely offset from an entrance 16 into a coin authenticating and counting apparatus generally designated 20. The faceplate 12 additionally defines a coin reject aperture 22 therethrough for passage of a coin when the coin authentication apparatus rejects an undersized coin C′ and returns the same to the user. Extending outwardly from the faceplate 12 and movable relative thereto is a lever 30 which is used to move the coin from a coin-receiving position (as illustrated in FIGS. 1, 3 and 5) to a coin-discharging position (as illustrated in FIGS. 2, 4 and 6). As best seen in FIGS. 5 and 6, the coin C in the coin-receiving position is generally aligned with the faceplate coin entry aperture 14 and substantially completely offset from the entrance 16 to the coin authenticating and counting apparatus 20; and the coin C in the coin-discharging position is substantially completely offset from the faceplate coin entry aperture 14 and generally aligned with the entrance 16 to the coin-authenticating and counting apparatus 20.

Figure 10:
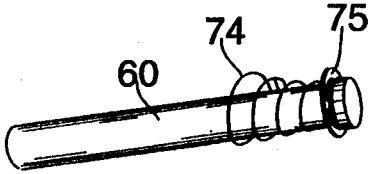
Figure 7:
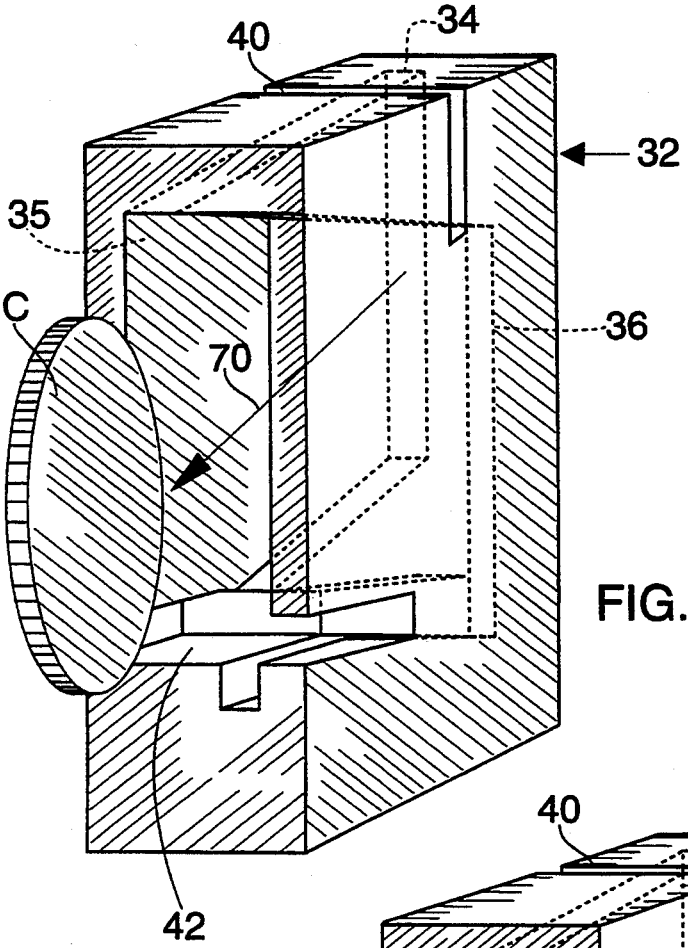
FIG. 7 is a perspective view of the travel of a properly sized coin through the chamber, as illustrated by an arrow.

In the preferred embodiment of the invention illustrated, the drop coin mechanism 10 plays a role in the coin authentication process. Thus the faceplate coin entry aperture 14 is configured and dimensioned to preclude the introduction of bent or oversized coins C′ past the faceplate 12 and into a coin holding body generally designated 32. The body 32 is movable slidingly, parallel to faceplate 12, along a cylindrical rod 60 (see FIG. 10) mounted on flanges 62 extending rearwardly from faceplate 12. Referring now also to FIG. 7, the coin-holding body 32 includes a front entrance 34 thereinto which is normally aligned with the faceplate coin entry aperture 14 (as illustrated in FIG. 5) and a rear exit 35 therefrom for properly sized coins C, both the front entrance 34 and rear exit 35 lying in a first plane. The coin-holding body 32 additionally defines at the front thereof a reject exit 36, which lies in a second plane offset from the first plane and normally aligned with the faceplate coin reject aperture 22 so that the undersized coins C′ received through the body entrance 34 are expelled through the body reject exit 36 in a manner to be described hereinafter.

It will be appreciated that the terms "undersized" and "oversized" are used herein with reference to a properly-sized coin for the desired denomination, whatever that proper size may be.

Figure 11:
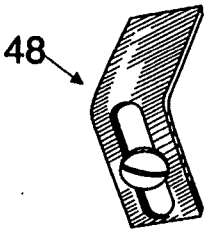

The coin-holding body 32 additionally defines a top slot 40 extending downwardly from the top surface thereof and a rear slot 42 extending forwardly from the rear surface thereof. A top bar 44 (see FIG. 9) is slidably received at least partially within the top slot 40 and biased downwardly therein by springs 46 secured to upper slots 47 at opposite ends thereof so that lower slots 49 rest on flanges 62 (as best illustrated in FIGS. 1 and 2). A rear bar 48 (see FIG. 11) is at least partially disposed within the rear slot 42 and serves to move undersized coins C' from the first plane defined by the body entrance 34 and body exit 35 to the offset and parallel second plane defined by the body reject exit 36, as will be discussed hereinafter. Both top bar 44 and rear bar 48 are stationary, while the body 32 is movable along rod 60 from its initial orientation through its intermediate orientation and back to its initial orientation.

Figure 9:
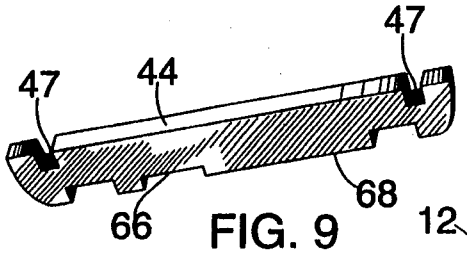
FIGS. 9, 10 and 11 are perspective views of the top bar, rod, and rear bar, respectively.

As best seen in FIG. 9, the bottom surface of the top bar 44 is irregular, defining a cut-out or raised portion 66 and a detent or lowered portion 68. When the body 32 is in its initial position (as illustrated in FIGS. 1, 3 and 5), the top bar detent or lowered portion 68 is aligned with the body front entrance 34 but spaced rearwardly thereof such that a properly sized coin C can enter the body 32 but is then immediately stopped by top bar 44 from any further movement downwardly and rearwardly toward the body rear exit 35. At this point, with the body 32 in its normal orientation, the body rear exit 35 is not aligned with the coin entrance 16 to the authentication and counting apparatus 20. On the other hand, when the user moves lever 30 to the right (as indicated in FIGS. 2, 4 and 6) as far as it can go, the body 32 is moved to its intermediate orientation wherein the body rear exit 35 is aligned with the entrance 16 to the coin authenticating and counting apparatus 20. At this point, the first plane including the body front entrance 34 is aligned with raised or cut-out portion 66 of the top bar 44 such that the coin C may resume its travel path under the influence of gravity, through the rear exit 35 and into the entrance 16 of authenticating and counting apparatus 20 (as indicated by the arrow 70 of FIG. 7), without any lateral shifting of the coin relative to body 32. It will be appreciated that when the body 32 is in the intermediate orientation, as the faceplate coin entry aperture 14 is no longer aligned with the body front entrance 34 but rather substantially laterally displaced therefrom (to the right as illustrated in FIG. 6), even a highly flexible tampering tool cannot traverse the two 90° angles which would be involved in passage of the tool from the faceplate coin entry aperture 14 through the body front entrance 34.

While the movement of lever 30 to cause movement of body 32 from the initial orientation to the intermediate orientation is normally under manual control of the user, the lever return (from the intermediate orientation to the initial orientation) may be effected either by the manual power of the user or automatically by a biasing means. As illustrated in FIGS. 1 and 2, a spring 74 disposed on rod 60 is compressed between flange 62 and clip 75 on the projecting rod end during the movement of the body 32 from the initial orientation to the intermediate orientation and then expands to force the return of the body 32 (and the lever 30) from the intermediate orientation to the initial orientation once the lever 30 is released by the user, so that the mechanism 10 is ready to receive another coin.

In a more sophisticated and larger embodiment of the present invention, the lever 30 may be dispensed with and the insertion of a coin through the faceplate coin entry aperture 14 or into body front entrance 34 may trigger a mechanism which automatically moves the body 32 first to its intermediate orientation and then back to its initial orientation.

It will be appreciated that an undersized coin C' received in the body entrance 34 is not ejected from the reject exit 36 until the coin-holding body 32 has passed from the initial orientation (illustrated in FIGS. 1, 3 and 5) through the intermediate orientation (illustrated in FIGS. 2, 4 and 6) and then back to the initial orientation (illustrated in FIGS. 1, 3 and 5).

Once the coin C passes through the entrance 16 of the coin authenticating and counting apparatus 20, it undergoes further authenticating and then finally counting. As illustrated, once the coin has already passed the undersize and oversize coin detectors of the drop coin mechanism 10 (including the faceplate 12), it is checked for at least a minimum weight by a cantilevered balance lever 80 pivotally extending through a slot in one of the flanges 62. If the coin is of appropriate weight for the denomination or greater, it will trip the lever 80 and fall downwardly under the influence of gravity. Its passage downwardly, towards the coin collection box (not shown), will be detected by a photo detector arrangement 82. It will be appreciated that additional and different authentication tests may be performed, and that additional and other counting techniques may be employed, a variety of each being conventional in the art.

Figure 8:
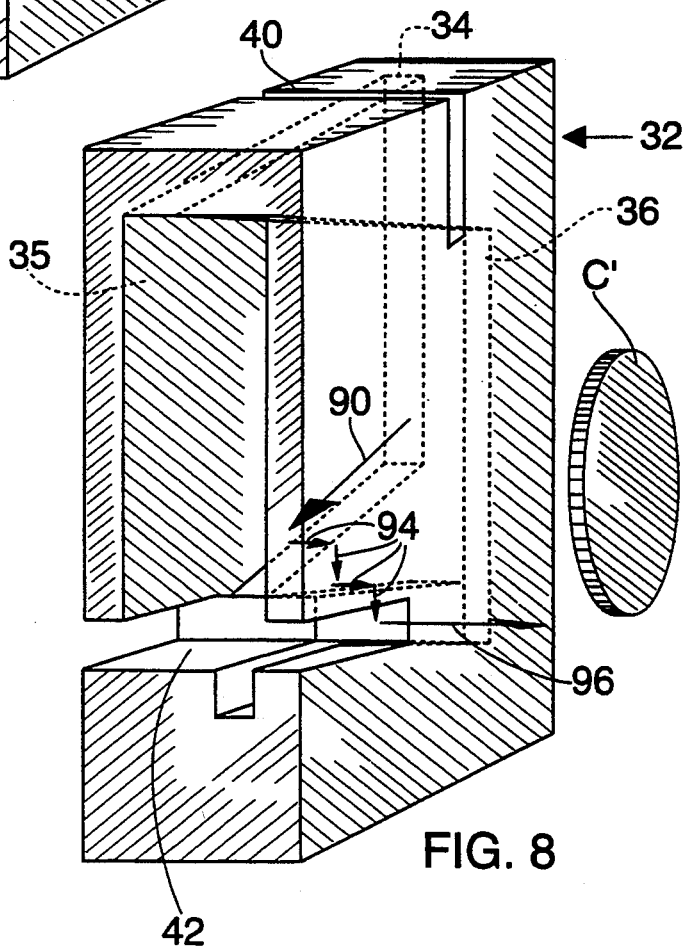
FIG. 8 is a perspective view of the travel of an undersized coin into and out of the chamber, via the return mechanism, as illustrated by arrows.

Referring now to FIG. 8, therein illustrated is the travel path of an undersized coin C'. The coin C' passing through the faceplate coin entry aperture 14 passes through the body front entrance 34, a travel path identical to that of an appropriately sized coin C. At this point, however, the travel paths differ. Whereas the detent 68 of upper bar 44 extends downwardly through slot 40 and bars further passage of the normal sized coin C until the body 32 has been laterally displaced and the coin C is aligned with cut-out portion 66, the undersized coin C' continues its passage into the body 32, in the direction of arrow 90 without impedance from the top bar 44 in slot 40. However an abutment stop 92 secured to one of the flanges 62 precludes passage of the undersized coin C' out of the body 32 through the rear exit 35 until the body 32 has been moved to its intermediate position (illustrated in FIGS. 2, 4 and 6). However, as the body 32 is being moved (via lever 30) from its initial orientation to its intermediate orientation, the rear bar 48 acts on the undersized coin C' as the body 32 is moved relative to the rear bar 48 (as illustrated in FIG. 8, the body 32 is moving so that the rear bar 48 moves from the left side of the body 32 to the right side thereof). As the body 32 is moved progressively into this intermediate orientation, the rear bar 48 causes the coin C' to move from adjacent one side of body 32 in the direction of arrows 94 downwardly and toward the other side until the coin rests adjacent the other side of body 32. At this point, the coin C' is aligned with the body reject exit 36 (i.e., in the second plane), but prevented from passing through the faceplate coin reject aperture 22 by the faceplate 12. However, once the lever 30 is released and the body 32 returns to its initial orientation (either under the influence of the spring 60 or in a non-biased embodiment when the lever 30 is manually returned to its initial position), the body reject exit 36 and the faceplate coin reject aperture 22 are aligned and the undersized coin C' then passes under the influence of gravity out of the body 32 and through the faceplate 12 in the direction of arrow 96.

It will be appreciated that while a coin reject mechanism is a desirable feature of a drop coin mechanism, in less sophisticated embodiments, the reject mechanism will not return the coin to the user, but simply allows it to enter the coin collection box without passing through the field of the counting apparatus, much as it does an underweight coin which does not trip lever 80.

The drop coin mechanism according to the present invention is extremely compact and is typically configured and dimensioned to replace existing drop coin mechanisms or otherwise fit in the limited space for a drop coin mechanism provided by an appliance manufacturer.

To use the drop coin mechanism, the user inserts a coin through the faceplate coin entry aperture 14, the coin then entering the body 32 through the coin front entry 34. The user then manually moves lever 30 to the right as illustrated in FIG. 5 and then either simply releases the lever (when the lever is biased for return or manually returns the lever to its initial position.

Assuming that the coin C is of appropriate size, its passage through the body 32 is initially blocked by a downwardly extending detent 68 of the top bar 44 so that it is not contacted later by the rear bar 48 extending into and sweeping through rear slot 42 as the body 32 is moved from its original orientation to its intermediate orientation. Then, when the body 32 reaches its intermediate orientation, the coin passes through a raised portion 66 of the top bar 44 and, now aligned with the entrance 16 to the coin authenticating and counting apparatus 20, passes through the body rear exit 35 and into such apparatus 20.

On the other hand, when the coin C′ is undersized, it is not stopped by the top bar 44, but proceeds in the direction of arrow 90 until it contacts stop 92 at the rear of body 32 in its initial orientation. Accordingly, as the body 32 is moved from its initial orientation to its intermediate orientation, the rear bar 48 extending into rear slot 42 dislodges the coin C′, forcing it to follow along the arrows 94 and pass from adjacent one wall of the body 32 to adjacent the opposite wall of the body 32. Then, once the body 32 is returned to its initial orientation, the undersized coin C′ is able to travel in the direction of arrow 96 and pass out of body front reject exit 36 and faceplate reject aperture 22 for return to the user.

To summarize, the present invention provides a drop coin mechanism for use with a coin authenticating and counting apparatus for preventing tampering with such apparatus. The mechanism is configured and dimensioned to replace existing drop coin mechanisms or otherwise fit in a limited space available for a drop mechanism provided by the appliance manufacturer. It may include return means for undersized coins.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A drop coin mechanism for use with a coin authentication and counting apparatus for preventing tampering with such apparatus, comprising:

(A) a faceplate defining a plane and an aperture therethrough for passage of a coin, said faceplate aperture being substantially completely offset from an entrance into a coin authenticating and counting apparatus; and (B) means, manually accessible from a front of said faceplate, extending out of the plane of said faceplate, and laterally movable parallel to the plane of said faceplate, for moving the coin from a coin-receiving position to a coin-discharging position, the coin in said coin-receiving position being generally aligned with said faceplate aperture and substantially completely offset from the entrance to the coin authenticating and counting apparatus, the coin in said coin-discharging position being substantially completely offset from said faceplate aperture and generally aligned with the entrance to the coin authenticating and counting apparatus;

whereby a tool for tampering with the coin authenticating and counting apparatus cannot be inserted into the entrance thereof through said faceplate aperture.

2. A drop mechanism for use with a coin authentication and counting apparatus for preventing tampering with such apparatus, comprising:

(A) a faceplate defining a plane and an aperture therethrough for passage of a coin;

(B) a coin transfer means defining a coin-holding body, an entrance thereto and an exit therefrom, said transfer means being movable between a coin-receiving position and a coin-discharging position, said transfer means in said coin-receiving position having said transfer means entrance aligned with said faceplate aperture and said transfer means exist substantially completely offset from an entrance to a coin authenticating and counting apparatus, said transfer means in said coin-discharging position having said transfer means entrance substantially completely offset from said faceplate aperture and said transfer means exist aligned with the entrance to the coin authenticating and counting apparatus, said transfer means entrance and said transfer means exit being aligned along a longitudinal axis; and (C) means for moving said transfer means from said coin-receiving position to said coin-discharging position;

said faceplate aperture being substantially completely offset from the entrance into the coin authenticating and counting apparatus such that tools for tampering with the coin authenticating and counting apparatus cannot be inserted into the entrance thereof through said faceplate aperture.

3. The mechanism of claim 2 wherein said transfer means is movable between said coin-receiving position and said coin-discharging position laterally along an axis generally transverse to said longitudinal axis.

4. The mechanism of claim 2 wherein said moving means is operable from the front of said faceplate and laterally movable.

5. The mechanism of claim 2 additionally including means for biasing said transfer means to said coin-receiving position.

6. The mechanism of claim 2 wherein said moving means also moves said transfer means from said coin-discharging position to said coin-receiving position.

7. The mechanism of claim 2 additionally including a size authenticating mechanism.

8. The mechanism of claim 8 wherein said faceplate aperture is configured and dimensioned to preclude passage therethrough of a coin oversized relative to an acceptable coin.

9. The mechanism of claim 7 additionally including restraining means disposed in said coin-holding body for restraining an acceptable coin against longitudinal movement from said transfer means entrance through said coin-holding body while said transfer means is in said coin-receiving position, while permitting a coin undersized relative to an acceptable coin to advance from said transfer means entrance through said coin-holding body.

10. The mechanism of claim 9 additionally including means for moving an undersized coin in said coin-holding body laterally relative to said transfer means as said transfer means moves from said coin-receiving position to said coin-discharging position.

11. The mechanism of claim 9 wherein said transfer means is laterally movable relative to said restraining means.

12. The mechanism of claim 11 wherein said restraining means is disposed a fixed distance above the bottom of said coin-holding body.

13. The mechanism of claim 11 wherein said restraining means is movable relative to said transfer means between an operable position wherein said restraining means restrains an acceptable coin from movement through said coin-holding body and an inoperable position higher than said operable position, said size authenticating mechanism additionally including means biasing said restraining means to said operable position.

14. The mechanism of claim 13 wherein said faceplate additionally defines a coin-return aperture therethrough for return to the user of an undersized coin which has been laterally moved relative to said transfer means by said moving means.

15. A drop coin mechanism for use with a coin authentication and counting apparatus for preventing tampering with such apparatus, comprising:

(A) a faceplate defining an aperture therethrough for passage of a coin;

(B) a coin transfer means defining a coin-holding body, an entrance thereto and an exit therefrom, said transfer means entrance and said transfer means exit being aligned along a longitudinal axis, said transfer means being movable laterally along an axis generally transverse to said longitudinal axis between a coin-receiving position and a coin-discharging position, said transfer means in said coin-receiving position having said transfer means entrance aligned with said faceplate aperture and said transfer means exit substantially completely offset from an entrance to a coin authenticating and counting apparatus, said transfer means in said coin-discharging position having said transfer means entrance substantially completely offset from said faceplate aperture and said transfer means exit aligned with the entrance to the coin authenticating and counting apparatus;

(C) laterally movable means, manually operable from the front of said faceplate, for laterally moving said transfer means between said coin-receiving position and said coin-discharging position; and (D) means for biasing said transfer means to said coin-receiving position;

said faceplate aperture being substantially completely offset from the entrance into the coin authenticating and counting apparatus such that tools for tampering with the coin authenticating and counting apparatus cannot be inserted into the entrance thereof through said faceplate aperture.

16. The mechanism of claim 15 additionally including a size authenticating mechanism, comprising said faceplate aperture being configured and dimensioned to preclude passage therethrough of a coin oversized relative to an acceptable coin, restraining means disposed in said coin-holding body for restraining an acceptable coin against longitudinal movement from said transfer means entrance through said coin-holding body while said transfer means is in said coin-receiving position, while permitting a coin undersized relative to an acceptable coin to advance from said transfer means entrance through said coin-holding body, said transfer means being movable relative to said restraining means, said restraining means being movable between an operable position wherein said restraining means restrains an acceptable coin from movement through said coin-holding body and an inoperable position higher than said operable position, said size authenticating mechanism additionally including means biasing said restraining means to said operable position, means for moving an undersized coin in said coin-holding body laterally relative to said transfer means as said transfer means moves from said coin-receiving position to said coin-discharging position, and a coin-return aperture in said faceplate for return to the user of an undersized coin which has been laterally moved relative to said transfer means by said moving means.

17. A drop coin mechanism for use with a coin authentication and counting apparatus for preventing tampering with such apparatus, comprising:

(A) a faceplate defining a plane and an aperture therethrough for passage of a coin;

(B) a coin transfer means defining a coin-holding body, an entrance thereto and an exit therefrom, said transfer means entrance and said transfer means exit being offset from one another, said transfer means having said transfer means entrance at least at times aligned with said faceplate aperture and said transfer means exit at least at times aligned with an entrance to a coin authenticating and counting apparatus; and (C) laterally movable means extending out of the plane of said faceplate and operable from a front of said faceplate for manually moving a coin in said coin transfer means laterally parallel to said faceplate plane from a coin-receiving position to a coin-discharging position, the coin in said coin-receiving position being substantially completely offset from the entrance to the coin authenticating and counting apparatus and in said coin-discharging position being substantially completely offset from said faceplate aperture;

said faceplate aperture being substantially completely offset from the entrance into the coin authenticating and counting apparatus such that tools for tampering with the coin authenticating and counting apparatus cannot be inserted into the entrance thereof through said faceplate aperture.

18. The mechanism of claim 17 additionally including means for biasing said moving means to move the coin to said coin-receiving position.

* * * * *